US012799683B2

(12) United States Patent
Lichtberger et al.

(10) Patent No.: US 12,799,683 B2
(45) Date of Patent: Nov. 17, 2026

(54) METHOD FOR COMPACTING BALLAST OF A TRACKBED

(71) Applicant: HP3 Real GmbH, Vienna (AT)

(72) Inventors: Bernhard Lichtberger, Vienna (AT); Markus Sollinger, Schlüßberg (AT)

( * ) Notice: Subject to any disclaimer, the term of this patent is extended or adjusted under 35 U.S.C. 154(b) by 401 days.

(21) Appl. No.: 18/292,861

(22) PCT Filed: Jul. 21, 2022

(86) PCT No.: PCT/AT2022/060264
§ 371 (c)(1),
(2) Date: Jan. 26, 2024

(87) PCT Pub. No.: WO2023/010147
PCT Pub. Date: Feb. 9, 2023

(65) Prior Publication Data

US 2024/0360631 A1 Oct. 31, 2024

(30) Foreign Application Priority Data

Aug. 4, 2021 (AT) ..... A50637/2021

(51) Int. Cl.
*E01B 27/20* (2006.01)

(52) U.S. Cl.
CPC ..... *E01B 27/20* (2013.01)

(58) Field of Classification Search
CPC ..... E01B 27/16; E01B 27/20
See application file for complete search history.

(56) References Cited

U.S. PATENT DOCUMENTS 4,369,712 A * 1/1983 von Beckmann ..... E01B 27/16 104/12
4,563,953 A * 1/1986 Theurer ..... E01B 27/16 104/10

(Continued)

FOREIGN PATENT DOCUMENTS

AT 369455 B 5/1982
AT 3916 U2 * 10/2000 ..... E01B 27/16

(Continued)

OTHER PUBLICATIONS

AT_513973_B1 espacenet machine translation (Year: 2026).*
WO2011023257A1 espacenet machine translation (Year: 2026).*

*Primary Examiner* — S. Joseph Morano
*Assistant Examiner* — Maxwell L Meshaka
(74) *Attorney, Agent, or Firm* — Tiajoloff & Kelly LLP

(57) ABSTRACT

A method for compacting ballast of a trackbed uses a tamping machine (A) that can travel on tracks in a working direction (W) and that is equipped with tamping tools (6, 16, 17, 18) for tamping, wherein the tamping tools are associated with tamping assemblies (1, 2, 3, 4) that can be moved vertically independently of one another and can be moved relative to one another transversely to the working direction (W) by means of a transverse movement drive (31). The tamping assemblies (1, 3 and 2, 4) are shifted relative to one another by a distance dV by means of the transverse movement drive (31) such that the mutually facing inner tamping tools of the tamping assemblies are offset relative to one another with a gap, and such that the opening width of the inner tamping tools is increased by an amount (d01,3i, d02,4i) such that the inner tamping tools at least partially overlap when viewed transversely to the working direction (W).

6 Claims, 5 Drawing Sheets

Fig. 1

(56) References Cited

U.S. PATENT DOCUMENTS

Figure 1:
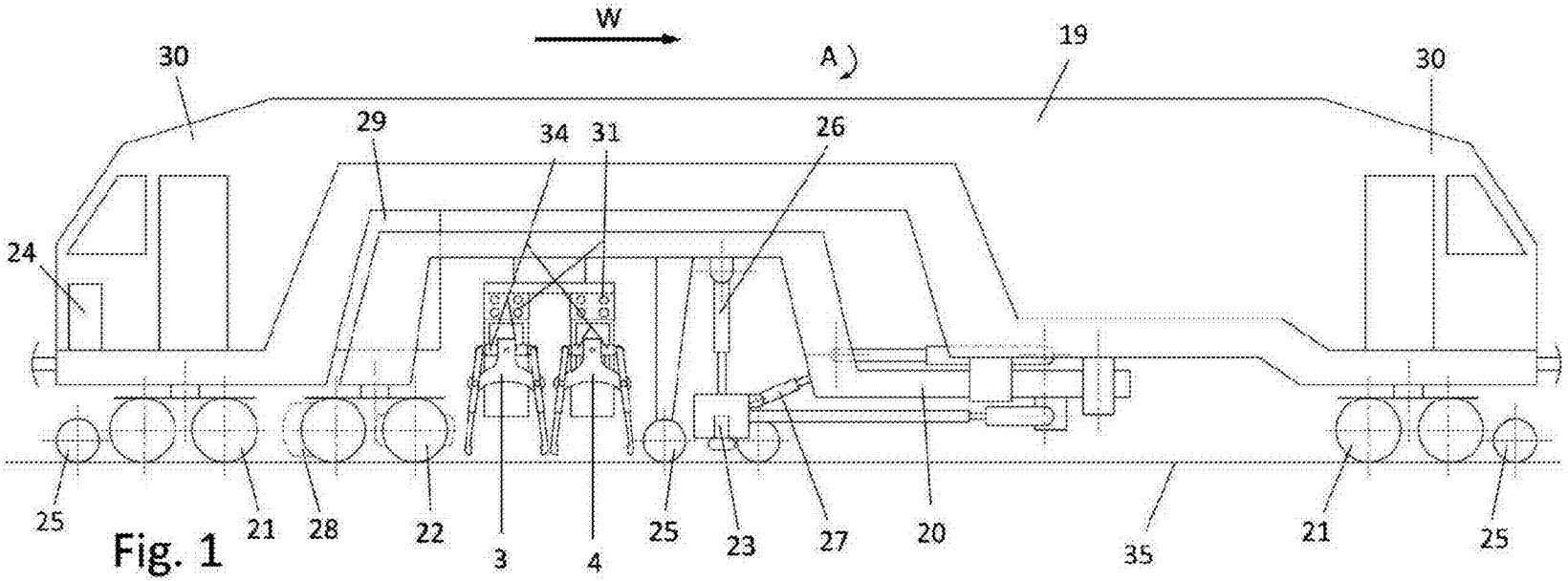

| | | | | |
|---|---|---|---|---|
| 5,048,425 | A | 9/1991 | Theurer | |
| 5,127,334 | A * | 7/1992 | Theurer | E01B 27/16 104/12 |
| 6,389,979 | B1 * | 5/2002 | Theurer | E01B 27/16 104/10 |
| 7,383,777 | B2 * | 6/2008 | Theurer | E01B 27/16 104/12 |
| 9,957,668 | B2 | 5/2018 | Lichtberger | |
| 10,100,469 | B2 * | 10/2018 | Lichtberger | E01B 27/16 |
| 10,240,300 | B2 * | 3/2019 | Lichtberger | E01B 27/17 |
| 10,550,525 | B2 * | 2/2020 | Lichtberger | E01B 27/17 |
| 10,794,009 | B2 * | 10/2020 | Lichtberger | E01B 27/17 |
| 11,713,547 | B2 * | 8/2023 | Lichtberger | E01B 27/16 104/10 |
| 11,802,380 | B2 * | 10/2023 | Wollanek | E01B 35/12 |
| 11,807,995 | B2 * | 11/2023 | Lichtberger | E01B 27/16 |
| 11,920,308 | B2 * | 3/2024 | Lichtberger | E01B 35/10 |
| 11,982,056 | B2 * | 5/2024 | Lichtberger | E01B 27/17 |
| 2006/0090666 | A1 | 5/2006 | Theurer et al. | |
| 2007/0283836 | A1 * | 12/2007 | Theurer | E01B 27/16 104/12 |
| 2016/0010287 | A1 | 1/2016 | Lichtberger | |
| 2017/0284033 | A1 * | 10/2017 | Lichtberger | E01B 27/17 |
| 2017/0328013 | A1 * | 11/2017 | Lichtberger | E01B 35/00 |
| 2018/0274179 | A1 * | 9/2018 | Lichtberger | E01B 27/17 |
| 2018/0298564 | A1 * | 10/2018 | Lichtberger | E01B 27/17 |
| 2019/0257038 | A1 * | 8/2019 | Wollanek | E01B 27/17 |
| 2020/0347557 | A1 * | 11/2020 | Lichtberger | E01B 35/10 |
| 2021/0002831 | A1 * | 1/2021 | Lichtberger | E01B 27/16 |
| 2021/0010206 | A1 * | 1/2021 | Lichtberger | E01B 27/16 |
| 2021/0222373 | A1 * | 7/2021 | Lichtberger | E01B 29/04 |
| 2022/0349128 | A1 * | 11/2022 | Lichtberger | E01B 27/023 |
| 2023/0228042 | A1 * | 7/2023 | Lichtberger | E01B 35/00 104/12 |
| 2023/0313470 | A1 * | 10/2023 | Lichtberger | E01B 27/17 104/10 |
| 2024/0271370 | A1 * | 8/2024 | Lichtberger | E01B 27/17 |
| 2024/0360631 | A1 * | 10/2024 | Lichtberger | E01B 27/16 |

FOREIGN PATENT DOCUMENTS

| | | | | |
|---|---|---|---|---|
| AT | 513973 | A1 | 9/2014 | |
| DE | 2424829 | A | 1/1976 | |
| DE | 4001235 | A1 | 12/1990 | |
| EP | 0208826 | A1 * | 1/1987 | E01B 27/16 |
| EP | 1653003 | A2 | 5/2006 | |
| GB | 2123462 | A * | 2/1984 | E01B 27/16 |
| WO | WO-2011003427 | A1 * | 1/2011 | E01B 27/16 |
| WO | 2011/023257 | A1 | 3/2011 | |
| WO | WO-2018149628 | A1 * | 8/2018 | E01B 27/16 |

* cited by examiner

METHOD FOR COMPACTING BALLAST OF A TRACKBED

FIELD OF THE INVENTION

The invention relates to a method for compacting ballast of a trackbed by means of a tamping machine which can travel on the track in the working direction and is equipped with tamping tools for tamping, wherein the tamping tools are associated with tamping assemblies with linear tamping drives and with displacement sensors for detecting the tamping path and the opening width of the tamping tools, wherein the tamping assemblies, which can be displaced vertically independently of one another, are arranged one behind the other in the working direction and can be displaced relative to one another transversely to the working direction by means of a transverse displacement drive.

DESCRIPTION OF THE PRIOR ART

Tamping assemblies use tamping tools to penetrate the ballast of a trackbed in the area between two sleepers (intermediate compartment), in the area of the sleeper support in the ballast under the rail and compact the ballast by dynamic vibration of the tamping tools between the opposing tamping tools, which can be set in relation to each other. Tamping assemblies can tamp one, two or more sleepers in one working cycle (DE 24 24 829 A, EP 1 653 003 A2). According to the teachings of AT513973A1, the adjusting drives, which act as linear drives, are designed in such a way that they not only generate a linear feed movement, but also the vibration required for the tamping tools. This allows the adjusting speed, the vibration amplitude, its shape and the frequency to be specified.

Track tamping machines are known from WO 2011023257 A1 and DE 4001235 A1, which have tamping assemblies for tamping several sleepers at the same time. The tamping tines, which are immersed in the same sleeper compartment, are arranged in a staggered manner in relation to each other. In order to enable only one tamping assembly to be lowered separately, WO 2011023257 A1 provides for the tamping tines of the unit not intended for lowering to be pivoted slightly with the aid of the adjusting drive in order to enable the adjacent unit to be lowered unhindered.

The movements of a tamping assembly comprise the vertical immersion of the tamping tools in the ballast of the trackbed, the adjusting movement in which the tamping tool ends are closed to each other and the superimposed dynamic vibration which causes the actual compaction of the ballast grains. It is well known to use hydraulic cylinders for the adjusting movement, which are connected to a vibration shaft with eccentricity via connecting rods and which superimpose the vibratory vibration on the feed movement (AT 369 455 B). These vibration shafts and connecting rods are supported by roller bearings that require regular, expensive maintenance. Other known solutions use a linear vibration generation and adjusting movement via hydraulic cylinders (AT513973A1).

Conventional tamping assemblies have stationary guide pillars arranged on the rail vehicle, along which the units are moved up and down with guides in the tamping box. The guides are located in areas above the assigned rail. The vibration shaft is located to the left and right of the center of the tamping box, which is moved up and down. The tamping arms with the tamping tools are driven by the vibration shaft via adjusting cylinders, which are connected to the eccentric shaft via connecting rods.

Single and double-sleeper switch tamping machines that work cyclically or continuously are also known. In switch tamping assemblies, the tamping tools are designed to be at least partially pivotable in order to be able to avoid rail obstacles. In the case of double-sleeper switch tamping assemblies, it is known to provide two independent subassemblies that are located on a common displacement frame that can be displaced transversely to the longitudinal direction of the machine. The two subassemblies can be lowered and raised vertically independently of each other. Independent fully hydraulic linear tamping drives are also known which act and are controlled individually on each tamping tool (AT 513 973 A). In particular, the adjusting path with the superimposed shape, amplitude and frequency of the compaction oscillation is electronically specified and measured via an integrated displacement sensor system.

The penetration resistance of the tamping assemblies depends on the position of the tamping tools in relation to each other. The smaller the effective area, the lower the penetration resistance, the lower the forces acting back on the tamping assembly and the faster the penetration, which means that the machine can work faster. The compaction process is only initiated when the tamping tools have reached a certain predetermined depth. Only then will the compaction effect of ballast under the sleeper be provided.

An embodiment of tamping assemblies for two-sleeper tamping machines is also known in which the tamping tools are slightly offset in the transverse direction and lie closer together. This results in a smaller effective penetration area. This type of tamping assembly is known as a center tool tamping assembly. The problem with tamping assemblies for switch tamping machines is that the tamping tools cannot be pivoted out with a type of center tool arrangement, as they are pivotable, which is why a center tool arrangement is not possible with these tamping assemblies. Railroads and machine operators often require so-called universal tamping machines that are equally suitable for switches and tracks. While the main focus in switches is on precise positioning and tamping of all areas of the switch, in track tamping it is the working speed that counts. The trend is therefore towards continuous two-sleeper universal tamping machines with pivoting tamping tools. The disadvantage of these designs is that they cannot form a narrow effective penetration area due to the pivotable tamping tools.

SUMMARY OF THE INVENTION

The invention is therefore based on the object of specifying a method which avoids the disadvantages mentioned above by providing a possibility for tamping assemblies to form the smallest possible effective penetration surface with the tamping tools during the immersion process, to reduce the penetration forces and to accelerate the penetration process, whereby the working speed of the tamping machine can be increased.

The invention solves the set object in that the tamping assemblies, in order to reduce an effective penetration area of the tamping tools into the trackbed, are displaced relative to one another by a distance dV with the transverse movement drive such that the mutually facing inner tamping tools of the tamping assemblies, which are arranged one behind the other in the working direction, are offset in a staggered manner relative to one another and that the opening width of the inner tamping tools is increased by an amount such that the inner tamping tools preferably partially overlap one another when viewed transversely to the working direction.

In track tamping operation, the two tamping assemblies are thus moved offset against each other to the desired extent in the transverse direction to the track and the tamping tool opening width of the inner tamping tools of the tamping assemblies in the longitudinal direction of the track is then opened further. The inner tamping tools facing each other as seen transversely to the working direction are staggered relative to each other. The outer tamping tools facing away from each other transversely to the working direction, i.e. the front and rear tamping tools seen in the working direction, are each offset together with the assigned tamping assemblies and the assigned inner tamping tools in the transverse direction to the track. If the mutually facing inner tamping tools of the tamping assemblies, which are arranged one behind the other in the working direction, are staggered with respect to each other, the opening width of the inner tamping tools can be increased without the tamping tools, which are now staggered with respect to each other, touching or hitting each other, which can lead to various types of damage, including tamping tool breakage. The compaction-side ends of the tamping tools, which are staggered, can preferably lie in a common tamping machine transverse plane and, optionally, interlock or completely overlap in the manner of gripper blade tines. The fact that the tamping tools lie at least approximately, preferably completely, in a common tamping machine transverse plane means that a minimum effective penetration area can be achieved. Wedging of ballast grains between facing inner tamping tools of the tamping assemblies arranged one behind the other in the working direction, which can also considerably increase the penetration resistance, is thus also prevented.

In order to reduce the effective area or the penetration resistance even further, it is advantageous if the inner tamping tools are set into synchronous oscillation by the associated linear tamping drives, at least when the tamping tools penetrate the trackbed, in such a way that the inner tamping tools always oscillate synchronously in the working direction.

This is possible with electronically controlled linear-acting fully hydraulic tamping drives (AT513973A1), as each hydraulic cylinder of the compacting and adjusting drive associated with one or more tamping tools can be controlled and regulated separately, which is also possible with eccentric drives. In the case of fully hydraulic tamping drives, an electronic control system precisely specifies the oscillation for each tamping tool, which means that synchronous oscillating drives can always be realized here. The cooperating tamping tools of a pair of tamping tools associated with a common tamping assembly, i.e. the inner and outer tamping tools associated with each other and each tamping a common sleeper, can vibrate synchronously or in opposite directions when penetrating the ballast, but they usually always vibrate in opposite directions for tamping.

In order to also be able to tamp switches advantageously or to be able to take rail construction obstacles into account if necessary, it is proposed that if one of the inner tamping tools of a tamping assembly is impeded in its oscillation as a result of a rail construction obstacle by an inner tamping tool of the adjacent unit in the working direction, the opening width of the impeding tamping tool is reduced with the associated linear tamping drive in such a way that the tamping tool can be pivoted out with a drive transversely to the working direction.

For this purpose, it is recommended that, for pivoting out the tamping tool with the drive, at least the opening width of the tamping tool to be pivoted out is reduced again by the amount of the overlap.

This means that a tamping tool position with a small, effective penetration area can also be realized for switch tamping where pivotable tamping tools are required in areas that require at least one tamping tool to be pivoted out, by only moving one or the other tool into a parking position and pivoting it out.

In particular, the opening width of the inner tamping tools, which partially overlap each other when viewed transversely to the working direction, is reduced by the amount of the overlap before the tamping assemblies are displaced transversely relative to one another. For this purpose, those tamping tools that are in the way can be pulled inwards towards the basic or adjusting position during the pivoting of the relevant tamping tool or before pivoting in order to clear the way for pivoting out before they return to the wider open position. If the individual tamping assemblies are to be moved relative to each other at right angles to the track, the opening width of the inner tines is automatically reduced beforehand. It is understood that the normal position of the sliding frames of the tamping tools and the tamping assemblies relative to each other is possible.

The main advantages of the invention are the reduction of the effective penetration area, the lower stress on the component due to the reduced penetration forces, the increase in working speed and the protection of the ballast.

BRIEF DESCRIPTION OF THE INVENTION

Figure 2:
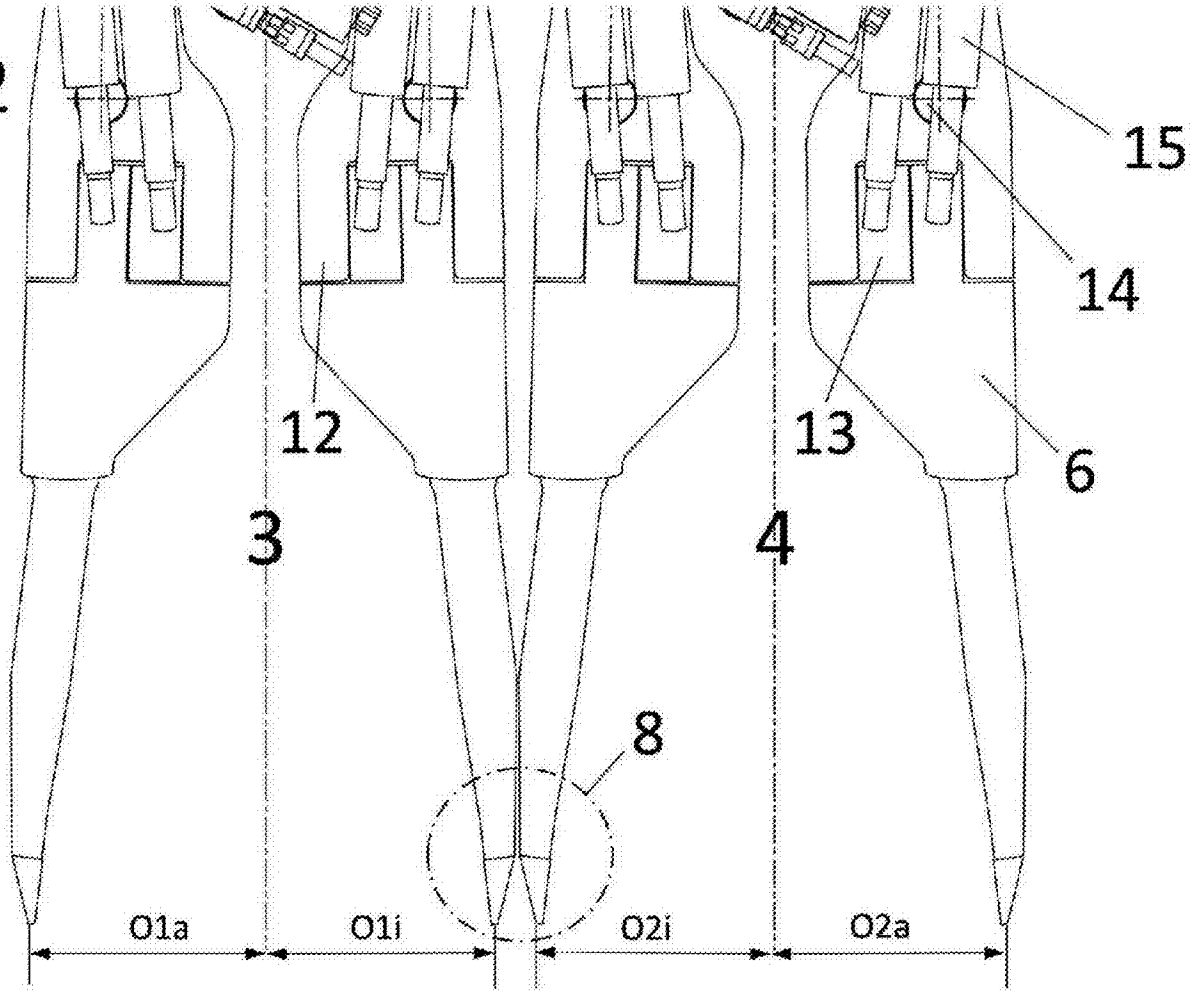
Figure 3:
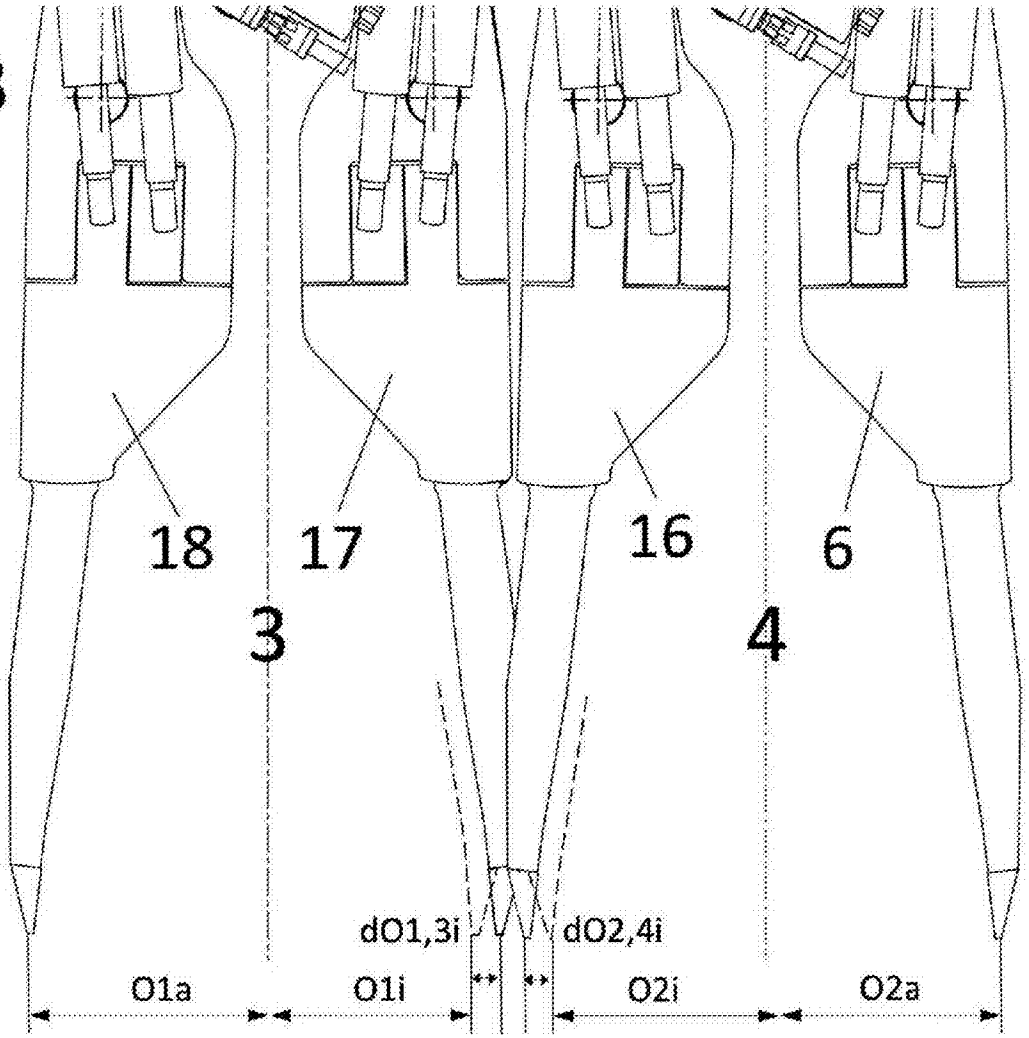
Figure 4:
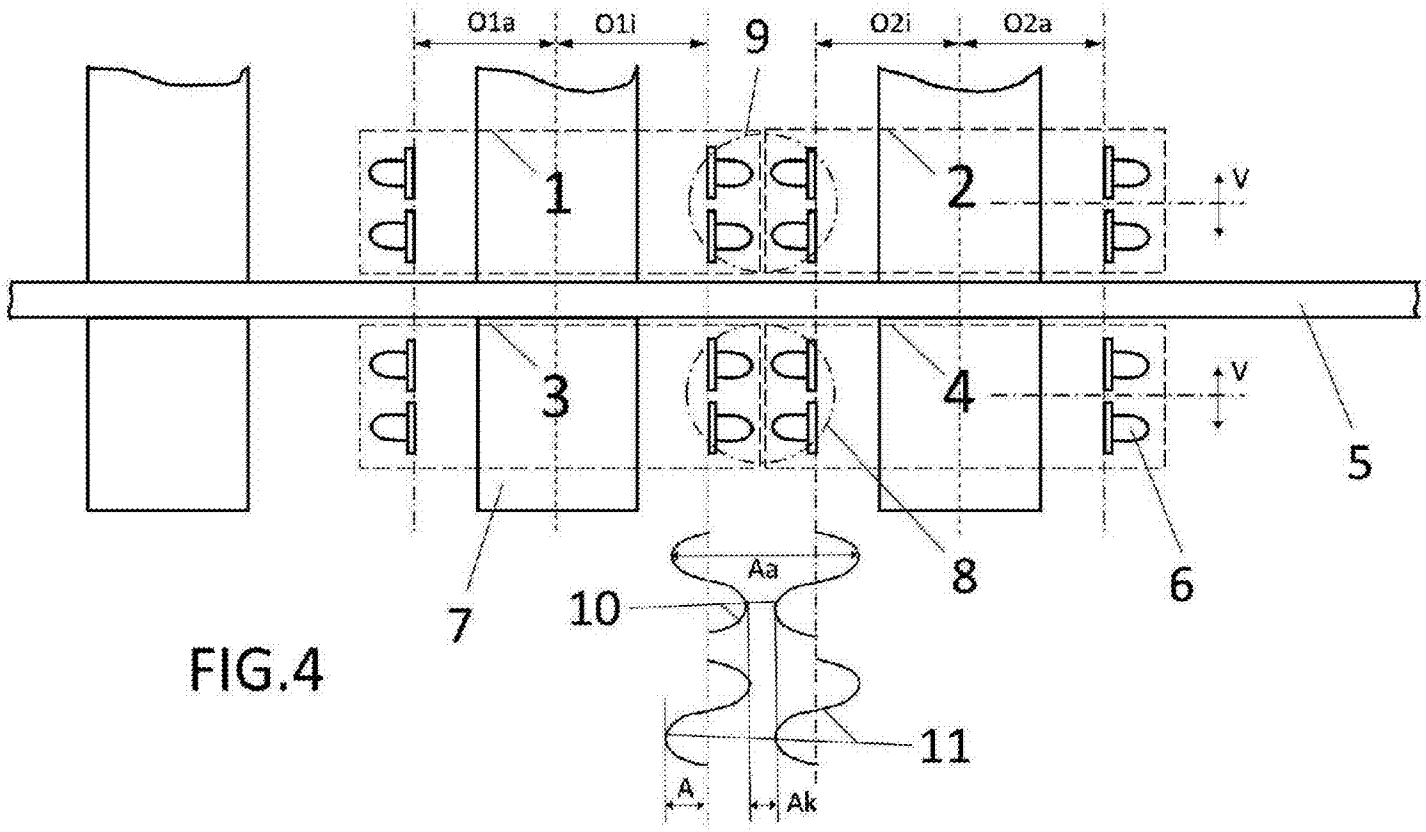
Figure 5:
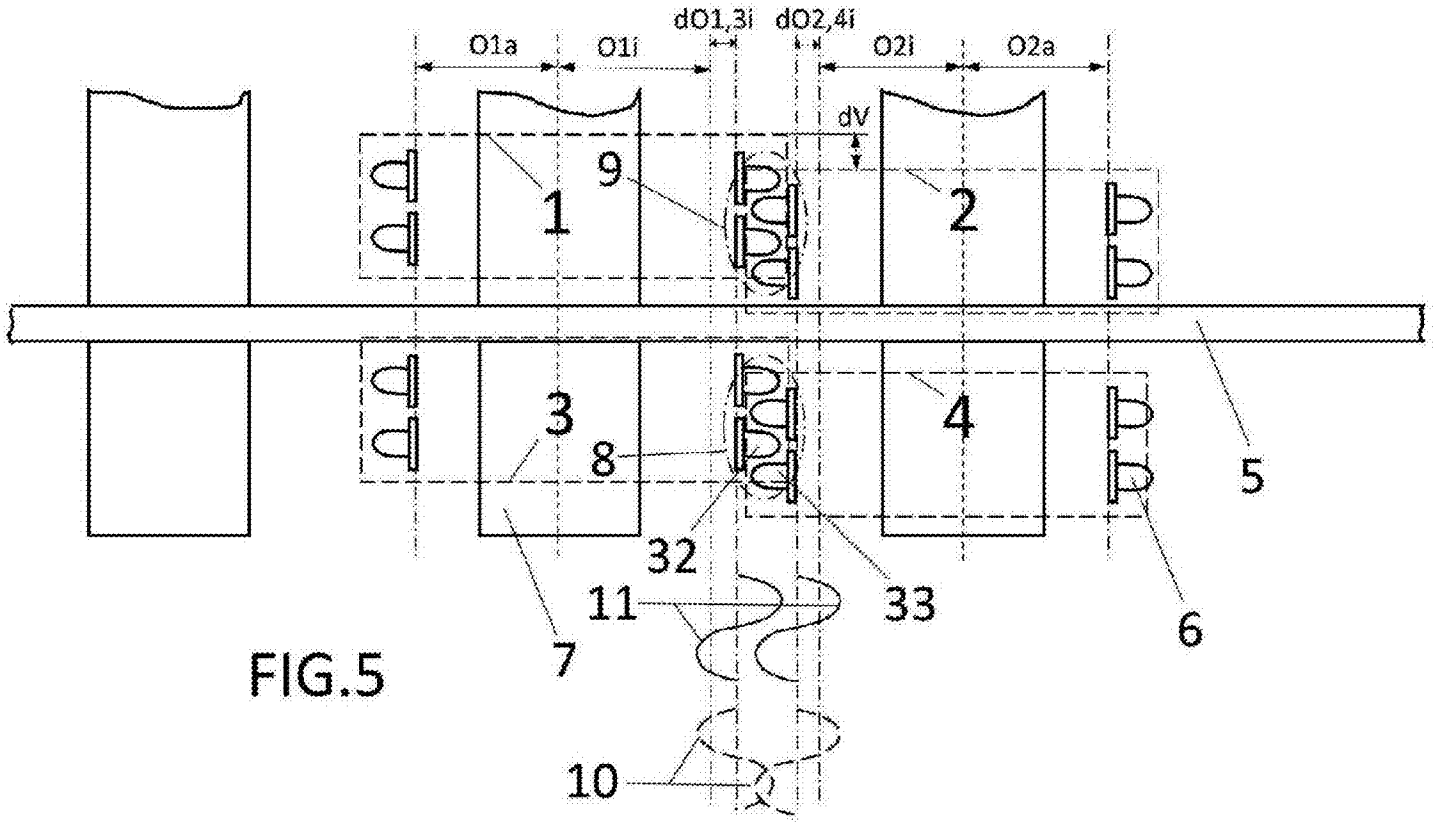

In the drawing, the subject matter of the invention is shown schematically by way of example, wherein:

FIG. 1 shows a side view of a continuously operating two-sleeper universal tamping machine, FIG. 2 shows a side view of an arrangement of two switch tamping assemblies in a known basic position, FIG. 3 shows a side view of an arrangement of the inner tamping tools according to the invention, FIG. 4 shows the arrangement of two switch tamping assemblies from FIG. 2 in a top view and FIG. 5 shows the top view of the arrangement according to the invention from FIG. 3.

DETAILED DESCRIPTION OF THE PREFERRED EMBODIMENTS

FIG. 1 shows a continuously operating universal two-sleeper tamping machine A moving in the working direction W. This can be moved on two bogies 21 on rails 35 and is equipped with two cabs 30. While the main machine 19 moves forward continuously, the working satellite 20, which can travel on a bogie 22 with its own working travel drive 28, is cyclically moved forward from one sleeper area to be worked on to the next sleeper area to be worked on. A track measuring system 25 is installed to measure the current track geometry. The track is lifted to the position to be corrected using the lifting tool 23 and lifting cylinders 26. At the same time, the track is aligned in its directional position using alignment cylinders 27. All sensor data is controlled, regulated and recorded by the machine's own computer and control system 24. Two tamping assemblies 3, 4 are arranged one behind the other in working direction W.

The tamping machine A is equipped with tamping tools 6, 16, 17, 18 for tamping, wherein the tamping tools 6, 16, 17, 18 are associated with tamping assemblies 1, 2, 3, 4 with linear tamping drives and with displacement sensors 34 for detecting the tamping path and the opening width of the tamping tines O1a, O1i, O2a, O2i. The tamping assemblies 1, 2, 3, 4 arranged one behind the other in the working direction W can be displaced vertically independently of one another and can be displaced relative to one another transversely to the working direction W by means of a transverse displacement drive 31.

The tamping assemblies 3, 4 are located on mutually independent displacement frames with transverse displacement drive 31, whereby the tamping assemblies 3, 4 can be displaced relative to one another by a desired amount transverse to the working direction W. The individual tamping tools 6, 16, 17, 18 are driven individually or in groups by a linear tamping drive 34, which can be controlled independently of each other. These are hydraulic cylinders equipped with the displacement sensors 34 that provide the adjusting path and the compaction oscillation. A machine operator has a view of the tamping assemblies 3, 4 via a work cabin 29.

FIG. 2 shows the tamping assemblies 3, 4 in a known arrangement, which can also be realized with the illustrated tamping machine A. The inner tamping tools are arranged in such a way relative to each other that they are at a distance 8 from each other so that they do not collide when vibrating against each other. Wedging of ballast grains between inner tamping tools facing each other cannot be prevented, which additionally increases the penetration resistance. The tamping tools, which can be pivoted out transversely to the working direction W, are guided by tamping tool arms 12, on which the linear tamping drives 34 act. The tamping tool arms 12 with the tamping tools are pivoted around axes 14 for tamping and adjusting, so that the opening width of the tamping tools can be adjusted. There is a separate drive 15 for each of the tamping tools shown, with which the tamping tools can be pivoted out transversely to the working direction W.

FIG. 3 shows the arrangement according to the invention in which the two tamping assemblies 3 and 4 are transversely displaced relative to one another by a distance in the transverse direction of the track, so that the tamping tools 16 and 17 can be opened further by an amount dO1,3i, dO2,4i, wherein the inner tamping tools 16, 17 partially overlap one another when viewed transversely to the working direction W. The position O1a, O2a of the two outer tamping tools 6, 18, between which the inner tamping tools 16, 17 are arranged, can remain unchanged if the opening width of the inner tamping tools 16, 17 is thus increased by the amount dO1,3i, dO2,4i shown.

The known arrangement from FIG. 2 is shown in top view in FIG. 4. The assemblies 1 and 3 as well as 2 and 4 are arranged transversely to the working direction W on one axis and can each be displaced transversely to the working direction W together or separately, which is particularly necessary for switch tamping, with the transverse displacement drive 31. The inner tamping tools 16, 17 are operated asynchronously 10 in the working direction W, i.e. vibrating in diametrically opposed directions, and must therefore be at a correspondingly large distance Aa from each other. This distance corresponds to at least twice the amplitude A plus a certain safety distance Ak. In the case of synchronous, i.e. rectified synchronous oscillation 11 of the tamping tools, only the safety distance Ak would come into play. With tamping amplitudes of typically 5-10 mm at the tamping tool ends, the asynchronous oscillation mode alone results in a distance increased by approx. 20 mm. The effective penetration surfaces 8, 9 are indicated as dotted circles.

FIG. 5 shows the arrangement according to the invention from FIG. 3. The tamping assemblies 1, 3 and 2, 4 are offset relative to one another by a distance dV with the transverse displacement drive 31 in order to reduce an effective penetration surface 8, 9 of the tamping tools 16, 17 into the trackbed in such a way that the inner tamping tools 16, 17 of the tamping assemblies 1, 3 and 2, 4, which are arranged one behind the other in the working direction W, facing one another, are offset in a staggered manner relative to one another. In addition, the opening width of the inner tamping tools 16, 17 is increased by an amount dO1,3i, dO2,4i such that the inner tamping tools 16, 17 at least partially overlap each other when viewed transversely to the working direction W.

The effective penetration areas 8, 9 are noticeably reduced compared to the penetration areas 8, 9 of standard operation shown in FIG. 4. According to the invention, the tamping tools 16, 17 oscillate synchronously, i.e. in the same harmonious oscillation 11, which is why the tamping tools 16, 17 can be moved closer together as if they were vibrating against each other. If the tamping tools were moved asynchronously 10, they would collide. The tamping assemblies 1 and 2, as well as 3 and 4, are displaced by the distance dV relative to each other in the transverse track direction and the inner tamping tool opening width is opened further by dO1,3i and dO2,4i. The opening width of the outer tamping tools 6 and 18 O1a and O2a, on the other hand, can remain unchanged.

If one of the inner tamping tools 32 of a tamping assembly 3 is obstructed in its oscillation by an inner tamping tool 33 of the adjacent unit 4 in the working direction W as a result of a rail obstacle, the opening width of the obstructing tamping tool 33 can be reduced via control electronics 24 with the associated linear tamping drive in such a way that the tamping tool 32 can be pivoted out transversely to the working direction W with the drive 15.

It is also possible to automatically set the tamping assemblies 1, 2, 3, 4 to the basic position according to FIG. 4 via a control request from the machine operator. If, in the position shown in FIG. 5, the machine operator requests that the tamping assemblies be moved transversely V to each other in the longitudinal direction of the track, then the inner tamping tools 16, 17 are automatically closed far enough to allow movement V against each other while maintaining the safety distance Ak. After displacement, the tamping tools 16, 17 can be opened further again, as this position is only required during the dipping process to achieve a smaller effective penetration area 8, 9.

The invention claimed is:

1. A method for compacting ballast of a trackbed, said method comprising:

providing a tamping machine that is supported to travel on a track in a working direction and that is equipped with tamping tools that are configured to tamp the track bed, wherein the tamping tools are associated with tamping assemblies with linear tamping drives and with displacement sensors detecting a tamping path and an opening width of tamping tines of the tamping tools;

wherein the tamping assemblies are supported so as to be displaced vertically independently of one another, are arranged one behind the other in the working direction, and are supported so as to be displaced relative to one another transversely to the working direction by a transverse displacement drive; and penetrating the trackbed with the tamping tools;

displacing the tamping assemblies relative to one another by a distance with the transverse displacement drive such that inner tamping tools of the tamping tools of the tamping assemblies are arranged one behind the other in the working direction, and are offset in a staggered manner relative to one another; and increasing the opening width of the inner tamping tools such that the inner tamping tools partially overlap one another when viewed transversely to the working direction;

wherein, at least during said penetrating of the trackbed, the inner tamping tools are set by the associated linear tamping drives into synchronous oscillation, wherein the inner tamping tools oscillate synchronously in the working direction.

2. The method according to claim 1, wherein, when one of the inner tamping tools of one of the tamping assemblies is impeded in oscillation thereof as a result of a rail construction obstacle by the inner tamping tool of the adjacent tamping assembly in the working direction, the opening width of the impeding tamping tool is reduced with the associated linear tamping drive such that the impeded tamping tool can be pivoted out with a drive transversely to the working direction.

3. The method according to claim 2, wherein, when the tamping tool is pivoted out with the drive, at least the opening width of the tamping tool to be pivoted out is reduced by the amount of the overlap.

4. The method according to claim 1, wherein the opening width of the inner tamping tools that partially overlap each other when viewed transversely to the working direction is reduced by an amount of the overlap before the tamping assemblies are displaced transversely relative to one another.

5. The method according to claim 2, wherein the opening width of the inner tamping tools that partially overlap each other when viewed transversely to the working direction is reduced by an amount of the overlap before the tamping assemblies are displaced transversely relative to one another.

6. The method according to claim 3, wherein the opening width of the inner tamping tools that partially overlap each other when viewed transversely to the working direction is reduced by an amount of the overlap before the tamping assemblies are displaced transversely relative to one another.

* * * * *